US008002396B2

(12) United States Patent
Yamada

(10) Patent No.: US 8,002,396 B2
(45) Date of Patent: Aug. 23, 2011

(54) INK CARTRIDGES, PRINTERS AND METHODS FOR MOUNTING SUCH INK CARTRIDGES TO SUCH PRINTERS

(75) Inventor: Takahiro Yamada, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1174 days.

(21) Appl. No.: 11/696,969

(22) Filed: Apr. 5, 2007

(65) Prior Publication Data

US 2007/0236549 A1 Oct. 11, 2007

(30) Foreign Application Priority Data

Apr. 5, 2006 (JP) ..... 2006-103797

(51) Int. Cl.
*B41J 2/175* (2006.01)

(52) U.S. Cl. ..... 347/86

(58) Field of Classification Search ..... 347/85, 347/86, 92

See application file for complete search history.

(56) References Cited

U.S. PATENT DOCUMENTS 5,119,115 A * 6/1992 Buat et al. ..... 347/86
6,378,998 B2 * 4/2002 Lim et al. ..... 347/86

FOREIGN PATENT DOCUMENTS

| | | | |
|---|---|---|---|
| JP | 40-14462 | * | 1/1992 |
| JP | 781076 | A | 3/1995 |
| JP | H9277554 | A | 10/1997 |
| JP | 10166607 | A | 6/1998 |
| JP | 2841700 | B2 | 12/1998 |
| JP | 2002154217 | A | 5/2002 |

* cited by examiner

*Primary Examiner* — Geoffrey Mruk
(74) *Attorney, Agent, or Firm* — Baker Botts L.L.P.

(57) ABSTRACT

The present invention relates to a method for mounting ink cartridges, an ink cartridge holder, and an inkjet printer. The method includes preventing an ink chamber and an exterior of the ink cartridge case from being in fluid communication, dispensing ink from an interior of the ink chamber to an exterior of the ink chamber via an opening, moving a moveable member into a second position after the moveable member has been in the first position, placing the ink chamber and the air chamber in fluid communication. The ink cartridge holder includes a case having a first opening and a second opening, a partition wall, and a moveable member. The inkjet printer includes an ink cartridge holder and a recording head, the ink cartridge holder having a joint portion and a moveable member.

6 Claims, 9 Drawing Sheets

(a)

(b)

INK CARTRIDGES, PRINTERS AND METHODS FOR MOUNTING SUCH INK CARTRIDGES TO SUCH PRINTERS

CROSS-RELATED APPLICATION

The present application claims priority from Japanese Patent Application No. JP-2006-103797, which was filed on Apr. 5, 2006, the disclosure of which is incorporated herein by reference in its entirety.

BACKGROUND OF THE INVENTION

1. Field of the Invention

The present invention relates generally to methods and systems for mounting an ink cartridge to an ink cartridge holder, to ink cartridges, and to inkjet printers. In particular, the present invention is directed towards ink cartridges comprising a case having a first opening and a second opening, a partition wall defining an ink chamber and an air chamber, and a moveable member disposed within the air chamber. The present invention also is directed towards an inkjet printer using a similar type of cartridge, and a method for mounting the ink cartridge on the inkjet printer.

2. Description of Related Art

A known ink cartridge in an inkjet printer is mounted to an ink cartridge holder. When the known ink cartridge mounted in the ink cartridge holder is replaced with a new ink cartridge, ink may leak from nozzles of a recording head of the inkjet printer, and the excess ink may collect on the ends of the nozzles. When an ink supply hole formed in the ink cartridge is connected to a joint portion provided in the ink cartridge holder, an airtight seal is created. The air caught between ink in the ink supply hole and ink in the joint portion may be compressed. The compressed air may apply pressure to ink contained within an ink supply passage which connects the joint portion of the ink cartridge holder and the recording head. This air pressure may force the ink through the recording head nozzles, and may cause ink to leak from the nozzles.

More specifically, in the known ink cartridge holder, when the ink supply hole is connected to the joint portion, the connection therebetween establishes an airtight ink passage between the ink cartridge and recording head. A filter is provided in the ink supply hole and the airtight ink passage is filled with ink. Pressure may be generated within the ink passages, and the menisci of ink formed within the nozzles may be damaged as a result of this pressure, because the menisci of ink formed within the nozzles is more fragile than menisci of ink formed within the filter's pores. Once the menisci of ink formed within the nozzles are damaged, the ink may leak from the nozzles.

Ink leaking from the nozzles creates a number of potential complications with the printing system. For example, the ink hanging from the nozzles may directly contact the recording medium, e.g., the paper The ink also may contact other parts of the inkjet printer, for example, the paper holder, and may be transferred to the surfaces of those other parts of the inkjet printer. This transferred ink eventually may adhere to the recording medium via the parts of the inkjet printer, which may diminish print quality and cause print errors. In a known system, once this ink leakage occurs, excess ink may be discharged from the nozzles to recover the print quality. A known inkjet recording system includes a sealing member with an air escape, which seals the connection between the ink supply hole and the joint portion. The sealing member may be provided at the ink supply hole or at the joint portion. The known inkjet recording system may allow air to escape through the air escape before the ink supply hole forms an airtight connection with the joint portion.

Nevertheless, in the known inkjet cartridge holder, once the ink supply hole is connected to the joint portion and the ink passage becomes airtight, air caught between the ink in the ink supply hole and the ink in the joint portion cannot escape to the outside.

SUMMARY OF THE INVENTION

Therefore, a need has arisen for methods for mounting an ink cartridge to an ink cartridge holder, ink cartridges, and inkjet printers, which overcome these and other shortcomings of the related art. A technical advantage of the present invention is that leakage of ink from nozzles when an ink cartridge is mounted to an ink cartridge holder is suppressed.

According to an embodiment of the present invention, a method for mounting an ink cartridge, the ink cartridge comprising a case having a first and second opening formed therethrough and an ink chamber formed within the case, comprises dispensing ink from an interior of the ink chamber to an exterior of the ink chamber via the first opening, selectively creating a seal between the first opening and a joint portion of an ink cartridge holder after dispensing ink from the interior of the ink chamber to the exterior of the ink chamber via the first opening, and placing the ink chamber and an exterior of the case in fluid communication via the second opening.

According to another embodiment of the present invention, an ink cartridge comprises a case having a first opening and a second opening formed therethrough, a partition wall disposed with in the case, and a moveable member disposed within the air chamber. The case and the partition wall define an ink chamber configured to store an ink and an air chamber therebetween, the partition wall separates the ink chamber from the air chamber, and the ink chamber is configured to be in fluid communication with the air chamber via the second opening. The air chamber is configured to guide the moveable member between a first position and a second position within the air chamber. When the moveable member is in the first position, the moveable member prevents fluid communication between the ink chamber and an exterior of the case via the second opening, and the ink is dispensed from an interior of the ink chamber to an exterior of the ink chamber via the first opening. When the moveable member is in the second position, the ink chamber and the exterior of the case are in fluid communication via the second opening.

According to still another embodiment of the present invention, an inkjet printer comprises an ink cartridge holder configured to removably mount an ink cartridge, and a recording head connected to a joint portion. The ink cartridge comprises a case having a first opening and a second opening formed therethrough, a partition wall disposed within the case. The case and the partition wall define an ink chamber configured to store an ink and an air chamber therebetween, the partition wall separates the ink chamber from the air chamber, and the ink chamber is in fluid communication with the air chamber. The ink cartridge holder comprises a joint portion configured to selectively create a seal with the first opening, and a moveable member configured to move from a first position to a second position when the ink cartridge is mounted to the ink cartridge holder. When the moveable member is in the first position, the moveable member prevents fluid communication between the ink chamber and the air chamber, and the ink is dispensed from an interior of the ink chamber to an exterior of the ink chamber via the first opening, and when the moveable member is in the second position, the ink chamber and the air chamber are in fluid communication via the second opening.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

FIG. 1(*b*) is a partial, expanded, cross-sectional view of the ink cartridge, according to an embodiment of the present invention.

FIG. 3(*b*) is a partial, expanded, cross-sectional view of the ink cartridge when a pump mechanism is in a second state, according to an embodiment of the present invention.

FIG. 6(*b*) is a partial, expanded, cross-sectional view of the ink cartridge when a pump mechanism is in a second state, according to another embodiment of the present invention.

DETAILED DESCRIPTION OF EMBODIMENTS OF THE INVENTION

Embodiments of the present invention, and their features and advantages, are understood by referring to FIGS. 1-9, with like numerals being used for like corresponding parts in the various drawings.

Figure 1:
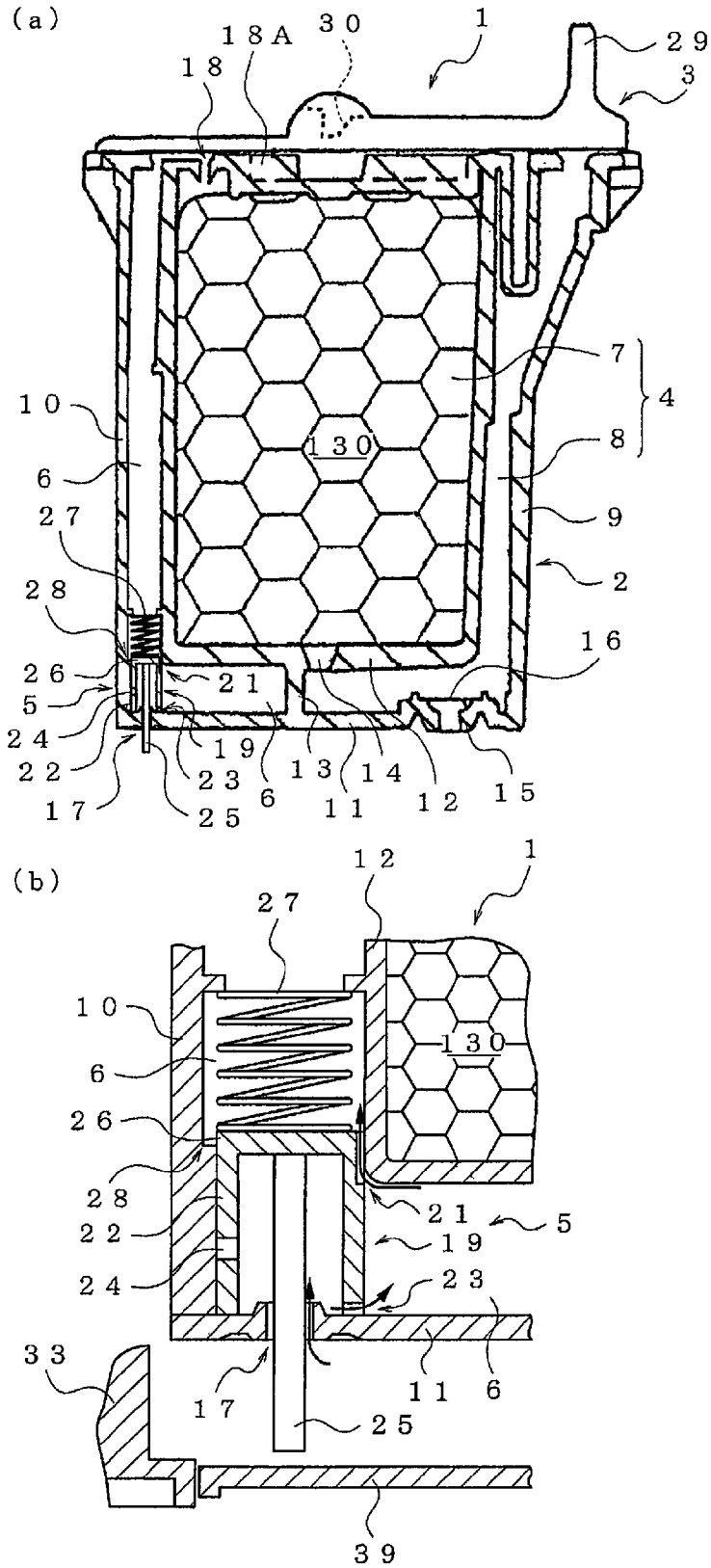
FIG. 1(*a*) is a cross-sectional view of an ink cartridge, according to an embodiment of the present invention.

Referring to FIGS. 1(*a*) and 1(*b*), according to an embodiment of the present invention, an ink cartridge 1 may comprise a box-shaped case 2 and a lid 3 attached to the top of box-shaped case 2. In an embodiment of the present invention, both case 2 and lid 3 may comprise synthetic resin or any similar substance. Ink cartridge 1 may comprise an ink chamber 4 formed within case 2 and ink may be stored within ink chamber 4.

In an embodiment of the present invention, case 2 may be a substantially hexahedron case comprising a case front wall 9, a case back wall 10 opposite to case front wall 9, a case top wall 18A, a case bottom wall 11 opposite to case top wall 18A, and two case side walls opposite to each other (not shown). Nevertheless, case 2 may have any geometric shape. The two case side walls may be parallel to the plane of FIGS. 1(*a*) and 1(*b*) and are not shown in the drawings. The interior of case 2 may be divided into an ink chamber 4 and an air chamber 6, and ink chamber 4 may be divided further into a first ink chamber 7 and a second ink chamber 8.

A partition wall 12 may be disposed within the interior of case 2, and first ink chamber 7 may be bounded by partition wall 12. Partition wall 12 may be separated from case front wall 9, case back wall 10 and case bottom wall 11. Partition wall 12 may comprise a first portion which faces case front wall 9 and may be substantially parallel to case front wall 9, a second portion which faces case back wall 10 and may be substantially parallel to case back wall 10 and a third portion that faces case bottom wall 11 and may be substantially parallel to case bottom wall 11. Partition wall 12 may be connected to both of the two case side walls. A negative pressure generating member 130 may be provided within first ink chamber 7. Negative pressure generating member 130 may comprise any suitable porous material which may accommodate ink therein.

A partition wall 13 also may be provided within the interior of case 2. Partition wall 13 may be connected to the third portion of partition wall 12 and case bottom wall 11. Partition wall 13 also may be connected to both of the two case side walls. Second ink chamber 8 is bounded by case front wall 9, a portion of case bottom wall 11, a portion of partition wall 12, and partition wall 13. Generally, ink chamber 8 stores ink, although the invention is not limited to embodiments in which the ink chamber stores ink or only ink. A communication hole 14 may be formed through partition wall 12, allowing first ink chamber 7 and second ink chamber 8 to be in fluid communication via a communication hole 14. Air chamber 6 may be bounded by case back wall 10, a portion of case bottom wall 11, a portion of partition wall 12, and partition wall 13.

A first opening, configured as an ink supply hole 15, may be formed through case bottom wall 11. Second ink chamber 8 may be in fluid communication with the outside of case 2 via ink supply hole 15. Ink stored in first ink chamber 7 and second ink chamber 8 may be supplied to the outside of case 2 via ink supply hole 15. One end of ink supply hole 15 may be connected to second ink chamber 8, and a filter 16 also may be provided at the end of ink supply hole 15. Ink menisci may form in the pores of filter 16. The capillary effect which may be created by negative pressure generating member 13 retains ink within the ink chamber 4, preventing the ink from leaking from ink supply hole 15.

A second opening, configured as an air communication hole 18, may be formed through case top wall 18A. First ink chamber 7 and air chamber 6 may be in communication with each other via air communication hole 18. An upper surface of air communication hole 18 and an upper surface of second ink chamber 8 may be closed by lid 3.

A vertical portion of air chamber 6 extends along case back wall 10 in the direction in which ink cartridge 1 may be mounted to an ink cartridge holder 31. A horizontal portion of air chamber 6 extends along case bottom wall 11. An air introduction hole 17, may be formed through case bottom wall 11. Air chamber 6 may be in fluid communication with the outside of case 2 via air introduction hole 17.

A piston 19 also may be provided within air chamber 6 and may divide air chamber 6 into two areas. Piston 19 may be configured to slide on case back wall 10, partition wall 12, and on the two case side walls along the direction in which ink cartridge 1 may be mounted to the ink cartridge holder 31.

Piston 19 may comprise a tube-shaped peripheral wall 22, and a top wall 26 closing one end of peripheral wall 22. The other end of peripheral wall 22 may be open and may face the air introduction hole 17. A first communication groove 21 may be formed in a portion of an outer surface 20 of peripheral wall 22 facing partition wall 12. First communication groove 21 may extend from top wall 26 to a middle portion of peripheral wall 22 along a direction parallel to a direction from the closed end of peripheral wall 22 to the open end of peripheral wall 22. A second communication groove 23 may be formed in an end of peripheral wall 22 facing case bottom wall 11. Second communication groove 23 extends from an inside of peripheral wall 22 to an outside of peripheral wall 22. Second communication groove 23 is formed directly below first communication groove 21. A third opening, configured as communication hole 24 may be formed through peripheral wall 22. Communication hole 24 may extend from the inside of peripheral wall 22 to an outside of peripheral wall 22, and faces case back wall 10. First communication groove 21, communication hole 24, and second communication groove 23 may be positioned in this order in the direction parallel to the direction from the closed end of peripheral wall 22 to the open end of peripheral wall 22. Additionally, an operation rod 25 extends from top wall 26 toward the open end of peripheral wall 22, and may extend beyond the peripheral wall 22.

A spring 27 may be provided within air chamber 6. Spring 27 contacts top wall 26 from above and urges the piston 19 toward air introduction hole 17. Operation rod 25 extends through air introduction hole 17 and protrudes to the outside of case 2. There may be a gap between operation rod 25 and a portion of case bottom wall 11 defining air introduction hole 17. Air may be introduced though air introduction hole 17.

Case back wall 10 may comprise an upper portion and a lower portion. The upper potion of case back wall 10 may be thinner than the lower portion of case back wall 10. A step 28 may be positioned between the upper portion and the lower portion of case back wall 10. Peripheral wall 22 of piston 19 contacts the lower portion of case back wall 10, however, there is a gap between peripheral wall 22 and the upper portion of case back wall 10. The piston 19 acts in combination with the air chamber 6 to function as a pump mechanism 5.

Lid 3 covers an upper surface of case 2. A protrusion 29 protrudes from an upper surface of lid 3. Protrusion 29 may be configured to engage a lever groove 44 provided at a lever 43 of ink cartridge holder 31. A notch 30 may be provided in the upper surface of lid 3. Notch 30 is configured to engage a pawl 46 provided at lever 43 of ink cartridge holder 31. Protrusion 29 may be positioned closer to case front wall 9 than to case back wall 10. Notch 30 may be positioned at a center of lid 3 in a direction from case front wall 9 to case back wall 10. In an embodiment of the present invention, ink cartridge holder 31 functions as a carriage configured to reciprocate above a recording medium. Ink cartridge holder 31 may comprise a bottom wall 35 and a back wall 33. Bottom wall 35 has a first end and a second end. Back wall 33 extends upwardly from the first end of bottom wall 35. A cross-section of ink cartridge holder 31 may have an "L" shape. A recording head 36 is fixed to a lower surface of bottom wall 35. Recording head 36 may comprise a nozzle surface 37, and a plurality of nozzles may be formed in nozzle surface 37. Openings of the plurality of nozzles face downward. A cover plate 38 also may be fixed to the lower surface of bottom wall 35. Cover plate 38 covers recording head 36, however, cover plate 38 exposes nozzle surface 37 and the plurality of nozzles contained therein.

A support plate 39 may be arranged to cover an upper surface of bottom wall 35. A hole 40 may be formed through support plate 39 at a position closer to the second end than to the first end. Joint portion 41 may be provided and exposed within hole 40. Joint portion 41 may be configured to be connected to the first opening, configured as the ink supply hole 15 of ink cartridge 1. In an embodiment, joint portion 41 may be in fluid communication with recording head 36. Therefore, ink in ink cartridge 1 may be supplied to the recording head 36 via joint portion 41. When used ink cartridge 1 is removed from the ink cartridge holder 31, some ink may remain in joint portion 41. In an embodiment of the present invention, a sealing member 42, which may comprise any suitable elastic material, may be attached to a periphery of joint portion 41. Sealing member 42 may achieve create an airtight seal at the connection between ink supply hole 15 and joint portion 41. A filter 41A may be provided at the top end of joint portion 41 to prevent foreign matter from contacting recording head 36.

Figure 2:
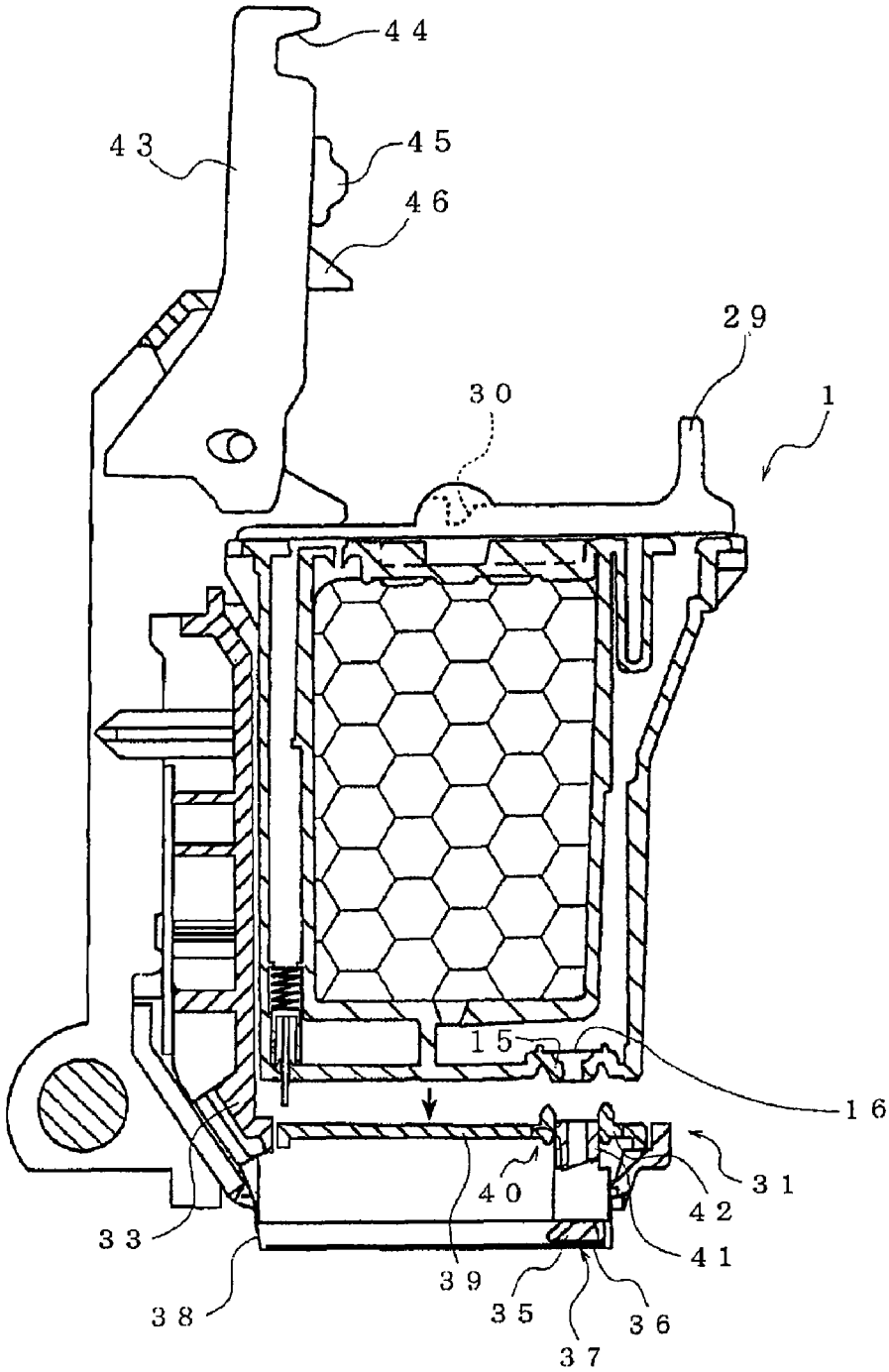
FIG. 2 is a cross-sectional view of the ink cartridge and an ink cartridge holder before mounting of the ink cartridge to the ink cartridge holder is complete, according to an embodiment of the present invention.

Lever 43 may be supported at an upper part of ink cartridge holder 31, and may be attached by a pivot for a limited range of motion. As shown in FIG. 2, a lever groove 44, a contact portion 45, and a pawl 46 may be provided at lever 43. In an embodiment of the present invention, contact portion 45 may be provided between lever groove 44 and pawl 46, and also may be urged to protrude from lever 43.

Ink cartridge 1 may first be placed on support plate 39, and lever 43 may be moved down. The movement of lever 43 causes protrusion 29 to engage lever groove 44, and pawl 46 to engage notch 30. Urged contact portion 45 then contacts the upper surface of lid 3, pressing ink cartridge 1 downward. The downward movement of ink cartridge 1 causes the first opening, configured as ink supply hole 15, to connect to joint portion 41. Sealing member 42 allows an airtight seal to be made at the connection of ink supply hole 15 and joint portion 41.

In an embodiment of the present invention, before the ink cartridge 1 is mounted to ink cartridge holder 31 and before pump mechanism 5 is actuated, the open end of peripheral wall 22 of piston 19 urged by spring 27 may contact an inner surface of case bottom wall 11, as shown in FIG. 1(*a*). In this state, a lower end of first communication groove 21 may be positioned below partition wall 12, allowing a second opening, configured as air communication hole 18, to communicate with the outside of case 2 via a combination of air chamber 6, first communication groove 21, second communication groove 23, and air introduction hole 17. During the mounting of ink cartridge 1 to ink cartridge holder 31, an end of operation rod 25 may contact support plate 39. As ink cartridge 1 moves downward, support plate 39 pushes operation rod 25 toward the interior of case 2. The movement of operation rod 25 causes piston 19 to slide toward the second opening, configured as air communication hole 18, against the urging force of spring 27, which acts in a direction opposite that of the pushing force exerted by support plate 39.

Figure 3:
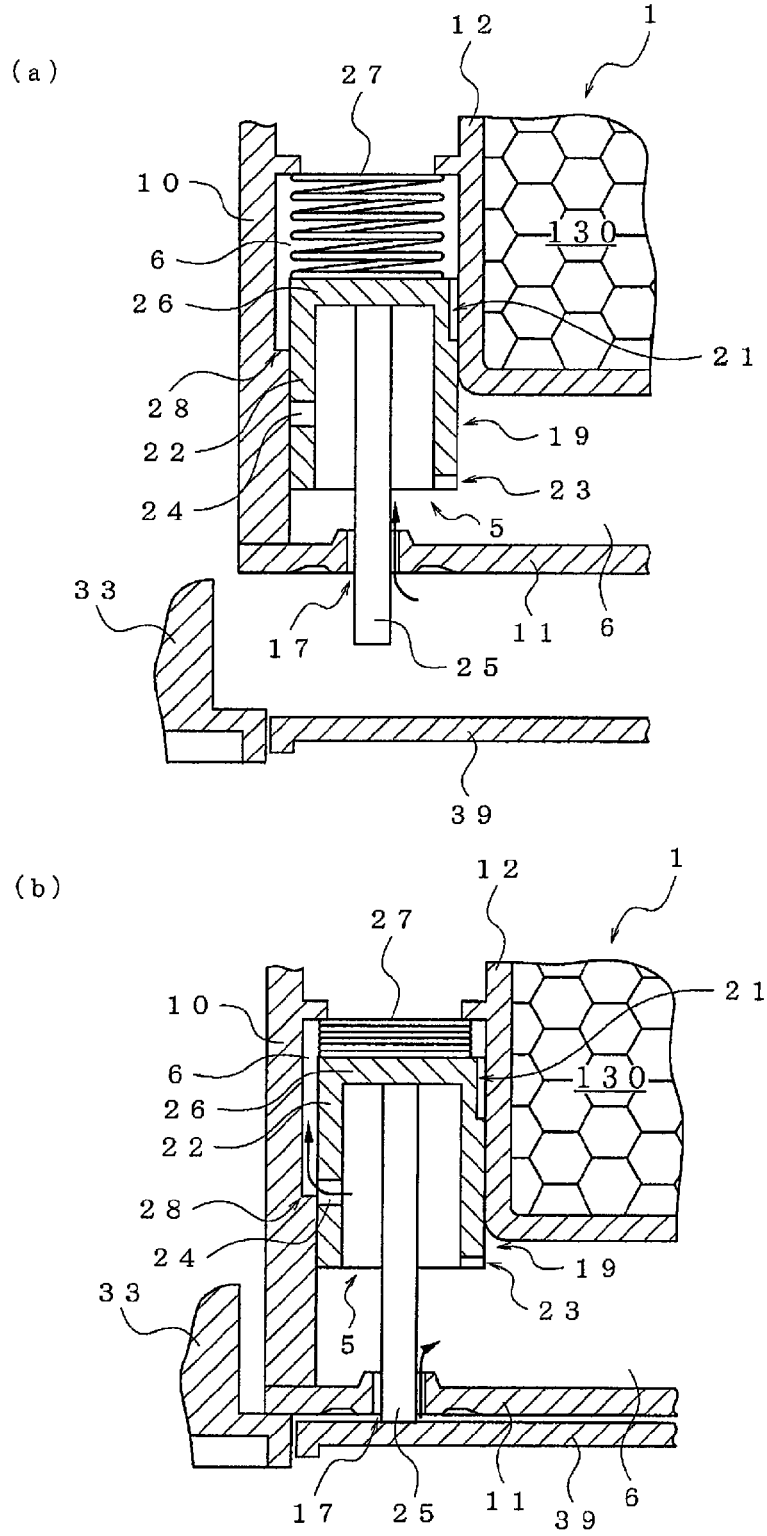
FIG. 3(*a*) is a partial, expanded, cross-sectional view of the ink cartridge when a pump mechanism is in a first state, according to an embodiment of the present invention.

As shown in FIG. 3(*a*), this movement causes the entirety of first communication groove 21 to face the second portion of partition wall 12, thereby preventing communication between the outside of case 2 and an upper portion of air chamber 6, e.g., the portion positioned above piston 19. This condition of pump mechanism 5 is hereafter referred to as a "first state" of pump mechanism 5.

As piston 19 slides further toward air communication hole 18, the piston 19 compresses the air in the upper portion of air chamber 6. This compressed air flows into first ink chamber 7 via air communication hole 18. The compressed air applies pressure to the ink within first ink chamber 7 and second ink chamber 8. The pressure may cause the ink menisci retained in the pores of filter 16 to become damaged, and ink in ink supply hole 15 may be pushed toward the outside of case 2, as represented by the dotted line in FIG. 4(*a*).

Figure 4:
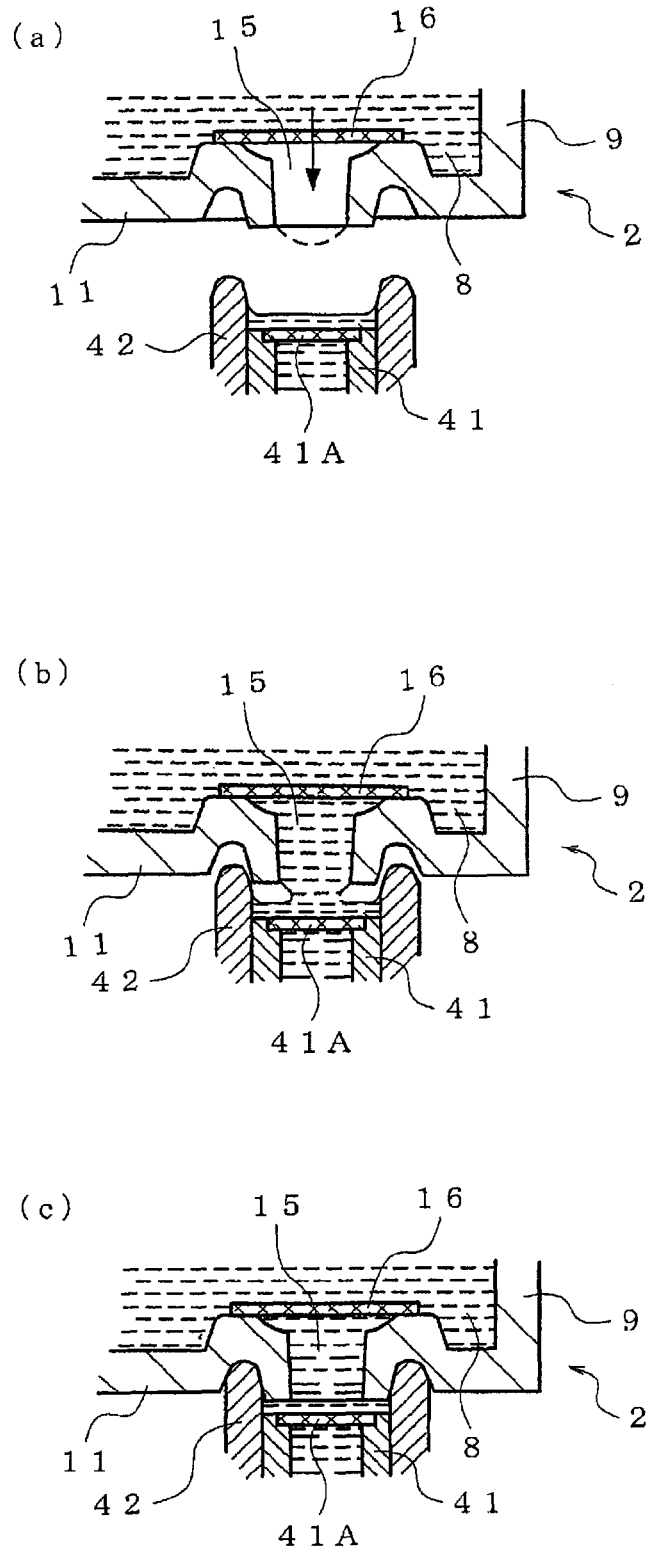
FIGS. 4(*a*)-4(*c*) are schematic diagrams showing a state of ink in a first opening, such as an ink supply hole and a joint portion during the mounting of the ink cartridge to the ink cartridge holder, according to an embodiment of the present invention.
Figure 5:
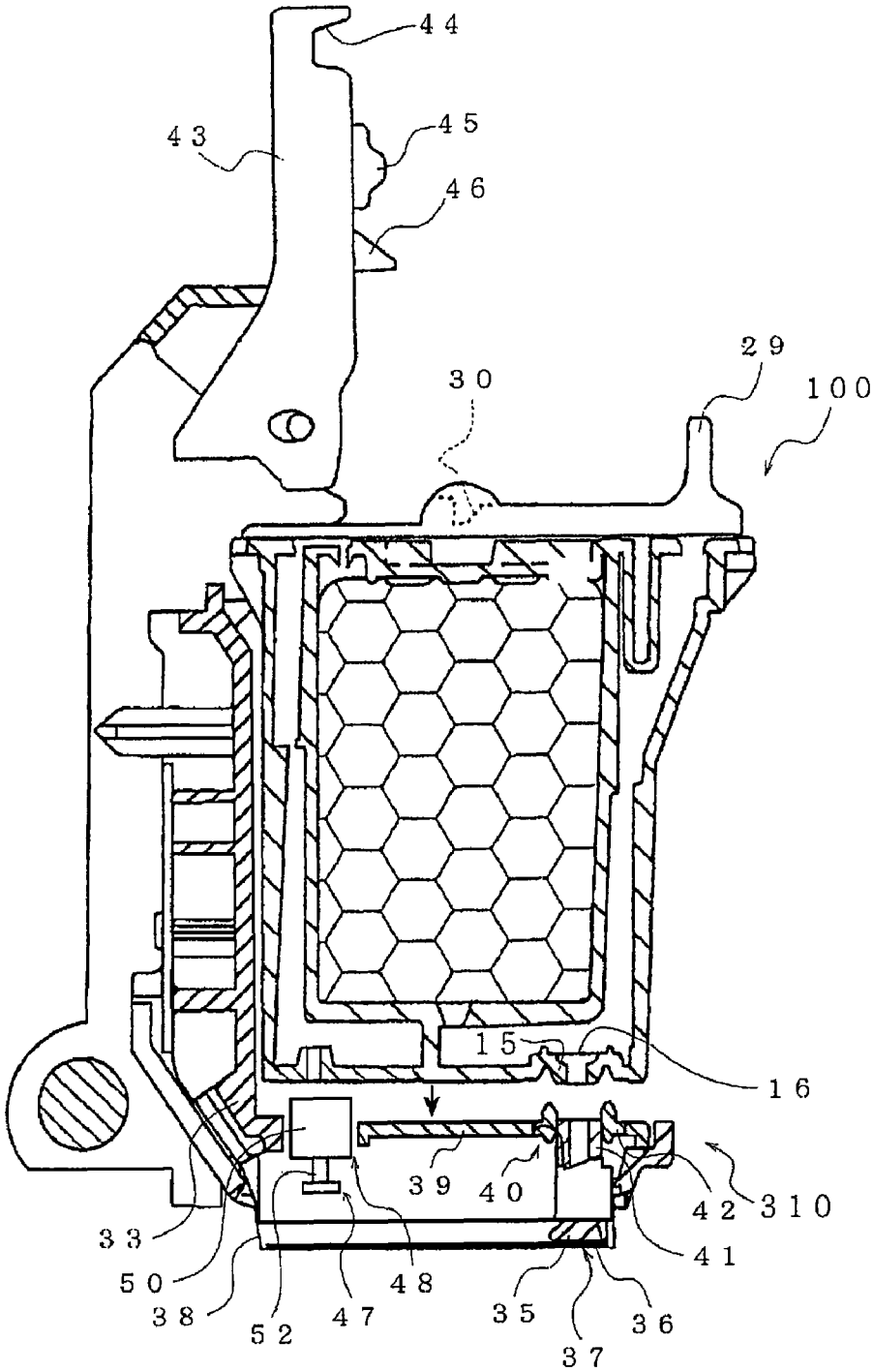
FIG. 5 is a cross-sectional view of the ink cartridge and an ink cartridge holder, before mounting of the ink cartridge to the ink cartridge holder is complete, according to another embodiment of the present invention.

As shown in FIG. 4(*b*), when ink supply hole 15 further approaches the joint portion 41 in the first state, the ink pushed out of ink supply hole 15 joins ink which has been retained in joint portion 41. In this first state, ink supply hole 15 and joint portion 41 are not in close contact with each other. Thus, the connected ink is under atmospheric pressure. Accordingly, no pressure is applied to the ink in joint portion 41 in this state, and ink within the plurality of nozzles of recording head 36 is not pushed.

When the mounting of ink cartridge 1 to ink cartridge holder 31 is completed, a portion of communication hole 24 is positioned above step 28, as shown in FIG. 3(*b*). In this condition of pump mechanism 5, hereinafter referred to as the "second state," first ink chamber 7 communicates with the outside of case 2 via the second opening, configured as air communication hole 18, air chamber 6, the third opening, configured as communication hole 24, and air introduction hole 17. At the same time, ink supply hole 15 is connected to joint portion 41, and sealing member 42 creates an airtight seal at the connection between ink supply hole 15 and joint portion 41.

After completion of the mounting of ink cartridge 1 to ink cartridge holder 31, the pressure applied to the ink is released. This pressure release is partially caused because first ink chamber 7 communicates with the outside of case 2. This communication allows negative pressure generating member 130 to generate capillary force, which may act as negative pressure, e.g., back pressure on ink within recording head 36 via ink within first ink chamber 7, second ink chamber 8, ink supply hole 15, and joint portion 14. The negative pressure retains menisci formed in the plurality of nozzles at a normal position. Accordingly, ink may be supplied from ink cartridge 1 to recording head 36 normally and ink may be ejected smoothly from the nozzles during normal operation.

The above-described pump mechanism 5 releases the pressure applied to ink in ink chamber 4 in part by establishing the communication between ink chamber 4 and the outside of case 2 at the same time when the air-tight connection between ink supply hole 15 and joint portion 14 is complete. Nevertheless, in some embodiments of the present invention, pump mechanism 5 may release the pressure applied to ink in ink chamber 4 after the air-tight connection between ink supply hole 15 and joint portion 14 is complete. When this occurs, ink may be pushed out of the nozzles of recording head 36 due to the pressure applied to ink in ink chamber 4. In these embodiments, however, the time elapsed between the completion of the connection of ink supply hole 15 and joint portion 1 and the release of the pressure applied to ink in ink chamber 4 is reduced. This reduced elapsed time allows the ink pushed out of the nozzles to return into the nozzles due to the negative pressure generated by negative pressure generating member 130.

In some embodiments of the present invention, pump mechanism 5 may release the pressure applied to ink in ink chamber 4 just before the airtight connection between ink supply hole 15 and joint portion 14 is complete. In these embodiments, the negative pressure generated by negative pressure generating member 30 may act on ink within recording head 36 before mounting of ink cartridge 1 to ink cartridge holder 31 is complete. This negative pressure may prevent ink from hanging from the nozzles. As described above, ink in ink supply hole 15 and ink in joint portion 14 may be in fluid communication with each other before the airtight connection between ink supply hole 15 and joint portion 14 is complete. Therefore, air may not remain caught between the ink in the ink supply hole 15 and the ink in joint portion 14. Accordingly, in an embodiment of the present invention, there is no need to discharge excess ink to recover print quality, thus conserving ink and prolonging the cartridge life.

When ink cartridge 1 is removed from ink cartridge holder 31, spring 27 may uncoil, causing piston 19 to return to an initial position. Nevertheless, in some embodiments of the present invention, spring 27 may be omitted, e.g., when ink cartridge 1 may not be removed from ink cartridge holder 31 until the ink within ink cartridge 1 is used up, and ink cartridge 1 becomes empty and must be replaced.

In an embodiment of the present invention, ink cartridge 1 may be packed in a bag and the interior of the bag may be depressurized. In this embodiment, when the depressurized bag is opened, if first communication groove 21 and second communication groove were not formed, a pressure difference might be produced between the upper portion of air chamber 6 above piston 19 and a lower portion of air chamber 6 below piston 19. This pressure difference might move piston 19 toward air communication hole 18. Nevertheless, by using the first communication groove 21 and second communication groove 23 formed in this embodiment, production of the pressure difference may be eliminated. First communication groove 21 and second communication groove 23 may be omitted in some embodiments of the present invention, when the interior of the bay is not depressurized.

In an embodiment of the present invention, operation rod 25 may be provided at support plate 39 of ink cartridge holder 31 instead of being provided at piston 19. In this case, operation rod 25 comes into air introduction hole 17 and pushes up piston 19 while ink cartridge 1 is mounted to ink cartridge holder 31.

FIGS. 5-8 describe an ink cartridge 100 and an ink cartridge holder 310 according to another embodiment of the present invention. Ink cartridge 100 may be similar to ink cartridge 1 and ink cartridge holder 310 may be similar to ink cartridge holder 31. Therefore, only the relevant differences between ink cartridge 100 and ink cartridge 1 and the relevant differences between ink cartridge holder 310 and ink cartridge holder 31 are discussed with respect to ink cartridge 100 and ink cartridge holder 310.

An opening 48 may be formed between back wall 33 and support plate 39 of ink cartridge holder 310. A pump mechanism 47 may be provided in opening 48 of ink cartridge holder 310 and protrude from support plate 39. Pump mechanism 47 may comprise cylinder 50 and piston 51. Cylinder 50 may further comprise an air chamber 49 therein, and piston 51 may be housed in ink chamber 49 and configured to slide on an inner surface of a cylindrical side wall 56 of cylinder 50. One end of a piston rod 52 may be connected to piston 51, and another end of piston rod 52 may be connected to bottom wall 35. An upper portion of cylinder 50 protrudes from support plate 39 through opening 48 of ink cartridge holder 310.

Cylinder 50 may comprise a cylindrical side wall 56 and a top wall 53A connected to one end of side wall 56. Air chamber 49 may open to the outside of cylinder 50 at another end of side wall 56. A connection hole 53 may be formed through top wall 53A, and air chamber 49 communicates with the outside of cylinder 50 through connection hole 53. A sealing member 54, which may comprise any suitable elastic material, may be attached to an outer surface of top wall 53A. Sealing member 54 may be formed into a sheet, and an opening may be formed through sealing member 54 at a position corresponding to connection hole 53. The diameter of the opening of sealing member 54 may be equal to the diameter of connection hole 53.

Figure 6:
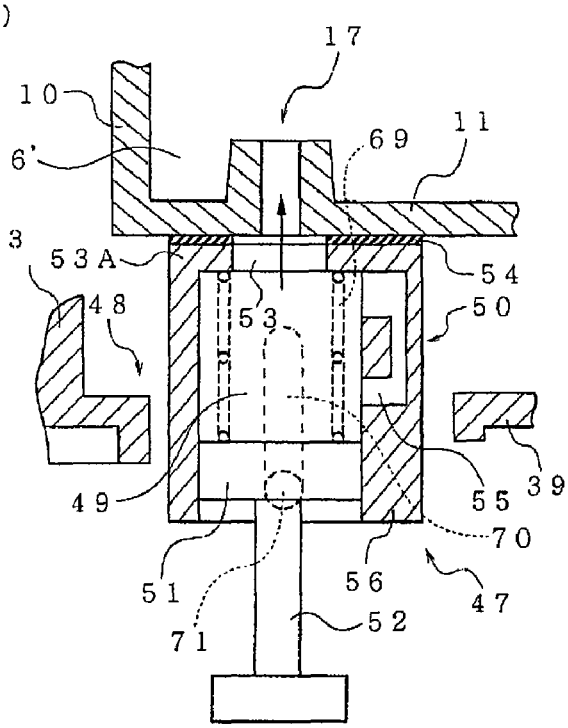
FIG. 6(*a*) is a partial, expanded, cross-sectional view of the ink cartridge when a pump mechanism is in a first state, according to another embodiment of the present invention.
Figure 6:
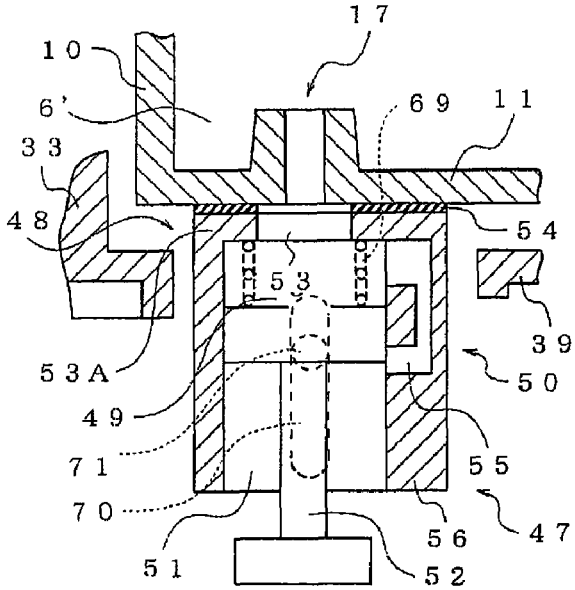
Figure 7:
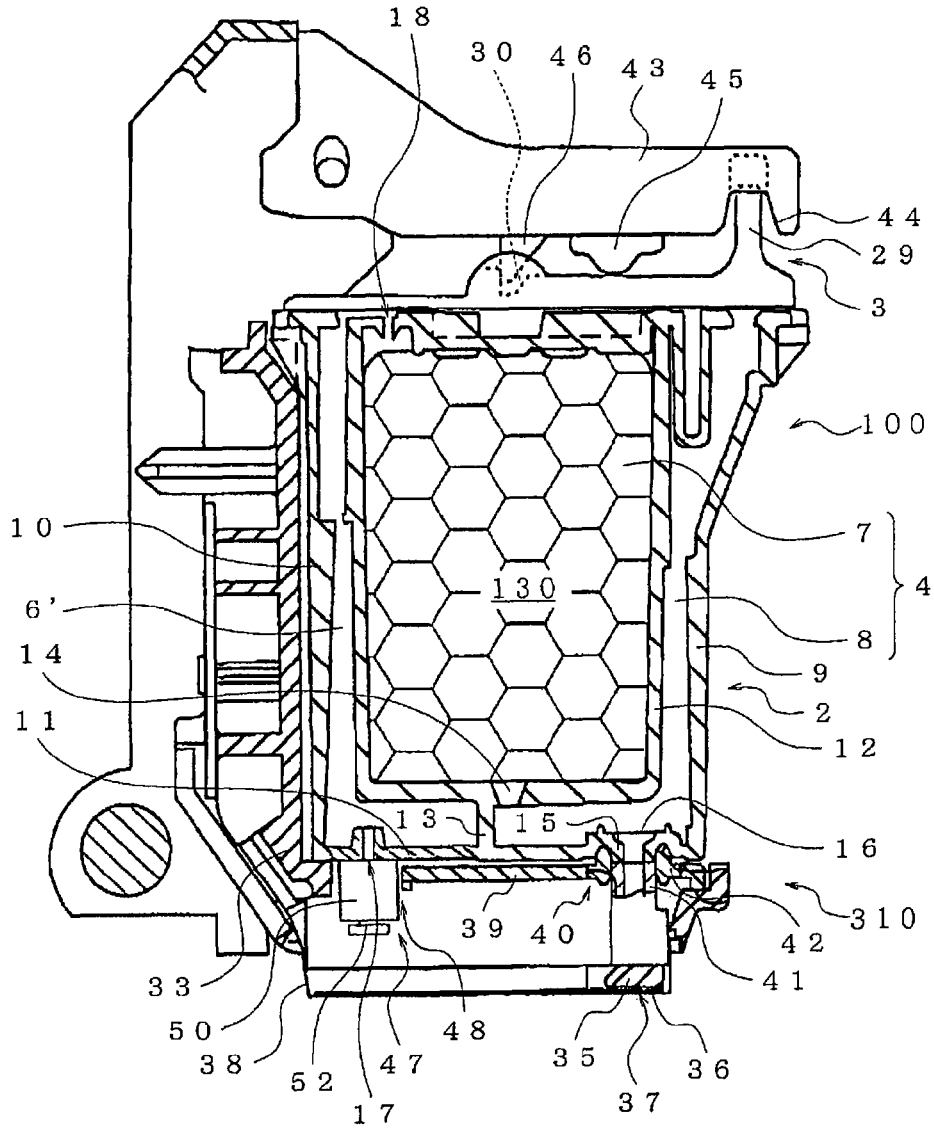
FIG. 7 is a cross-sectional view of the ink cartridge and an ink cartridge holder, when mounting of the ink cartridge to the ink cartridge holder is complete, according to another embodiment of the present invention.
Figure 8:
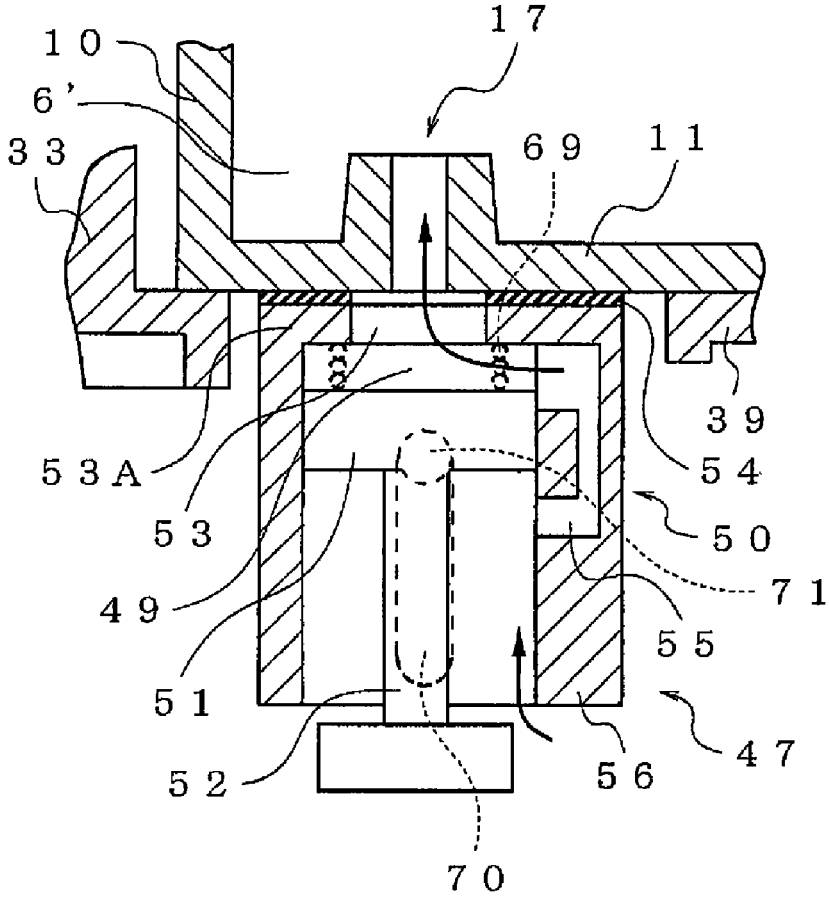
FIG. 8 is a partial, expanded, cross-sectional view of the pump, when mounting of the ink cartridge to the ink cartridge holder is complete, according to another embodiment of the present invention.

As illustrated in FIGS. 6(*a*) and 6(*b*), a guide groove 70 may be formed in an outer surface of side wall 56 of cylinder 50 and a guide pin 71 provided at holder 310 engages guide groove 70. When cylinder 50 is moved, guide pin 71 may slide in guide groove 70 and guides the movement of cylinder 50.

When ink cartridge 100 contacts cylinder 50, sealing member 54 may generate friction force, which prevents air introduction hole 17 and connection hole 53 from being offset from each other. Sealing member 54 also may selectively create an airtight seal at the connection between air introduction hole 17 and connection hole 53.

A spring 69 may be provided within air chamber 49 and positioned between an inner surface of top wall 53A and piston 51. Spring 69 may be positioned to urge piston 51 toward piston rod 52. A passage 55, which may be formed in side wall 56 and may extend toward top wall 53A in side wall 56, has a lower end and an upper end. A lower end of passage 55 may be open to air chamber 49 at the inner surface of side wall 56, and an upper end of passage 55 may be open to air chamber 49 at the inner surface of side wall 56. Piston 51 may be positioned below the lower end of passage 55 when piston 51 is urged by spring 69. As piston 51 moves upward in ink chamber 49, piston 51 may move to a position between the lower end of passage 55 and the upper end of passage 55, thus, placing an upper portion of air chamber 59 above piston 51, and a lower portion of air chamber 59 below piston 51. This movement of piston 51 also may allow communication between the upper portion of air chamber 49 and the lower portion of air chamber 49 via the passage 55.

In an embodiment of the present invention, ink cartridge 100 may not have a pump mechanism. In this embodiment, an air chamber 6' extends from case bottom wall 11 to the second opening, configured as air communication hole 18, along case back wall 10. Thus, ink chamber 7 may communicate with the outside of case 2 via a combination of air communication hole 18, air chamber 6' and air introduction hole 17.

When ink cartridge 100 is mounted to ink cartridge holder 310, a bottom surface of case bottom wall 11 may contact an upper surface of cylinder 50, causing air introduction hole 17 and connection hole 53 to align as shown in FIG. 6(*a*). In this alignment, air chamber 6' and air chamber 49 may communicate via air introduction hole 17 and connection hole 53.

As ink cartridge 100 is pushed further down, cylinder 50 also may be pushed down. While cylinder 50 is pushed down, communications between air introduction hole 17 and connection hole 53 may be maintained. Further, while cylinder 50 is pushed down, communications between air communication hole 18 and connection hole 53 via air chamber 6' also may be maintained.

Before cylinder 50 is pushed down, piston 51 may be positioned below the lower end of passage 55. When cylinder 50 is pushed down, air may be compressed in air chamber 49. This compressed air flows into first ink chamber 7 via air chamber 6'. This condition of pump mechanism 47 will hereafter be referred to as a "first state" of pump mechanism 47. The compressed air applies pressure to ink within first ink chamber 7 and second ink chamber 8. The pressure causes menisci retained in the pores of filter 16 to be damaged, and ink in ink supply hole 15 may be pushed to the outside of case 2, where the ink may connect with ink in joint portion 41.

As the cylinder 50 is pushed further down, piston 51 may move to a position between the lower end of passage 55 and the upper end of passage 55. When the cylinder is in this position, air chamber 6' may communicate with the atmosphere via passage 55. This condition of pump mechanism 47 will hereafter be referred to as a "second state" of pump mechanism 47. When the mounting of ink cartridge 100 to ink cartridge holder 310 is complete, cylinder 50 may be pushed further down while the communication between air chamber 6' and the atmosphere is maintained. When this occurs, the first opening, configured as ink supply hole 15 connects to joint portion 41, creating an airtight seal with the sealing member 42.

When air chamber 6' communicates with the atmosphere, the pressure applied to ink in first ink chamber 7 may be released. The negative pressure generated by negative pressure generating member 130 may retain menisci formed in the plurality of nozzles at a normal position, allowing optimal operation of the print mechanism.

Figure 9:
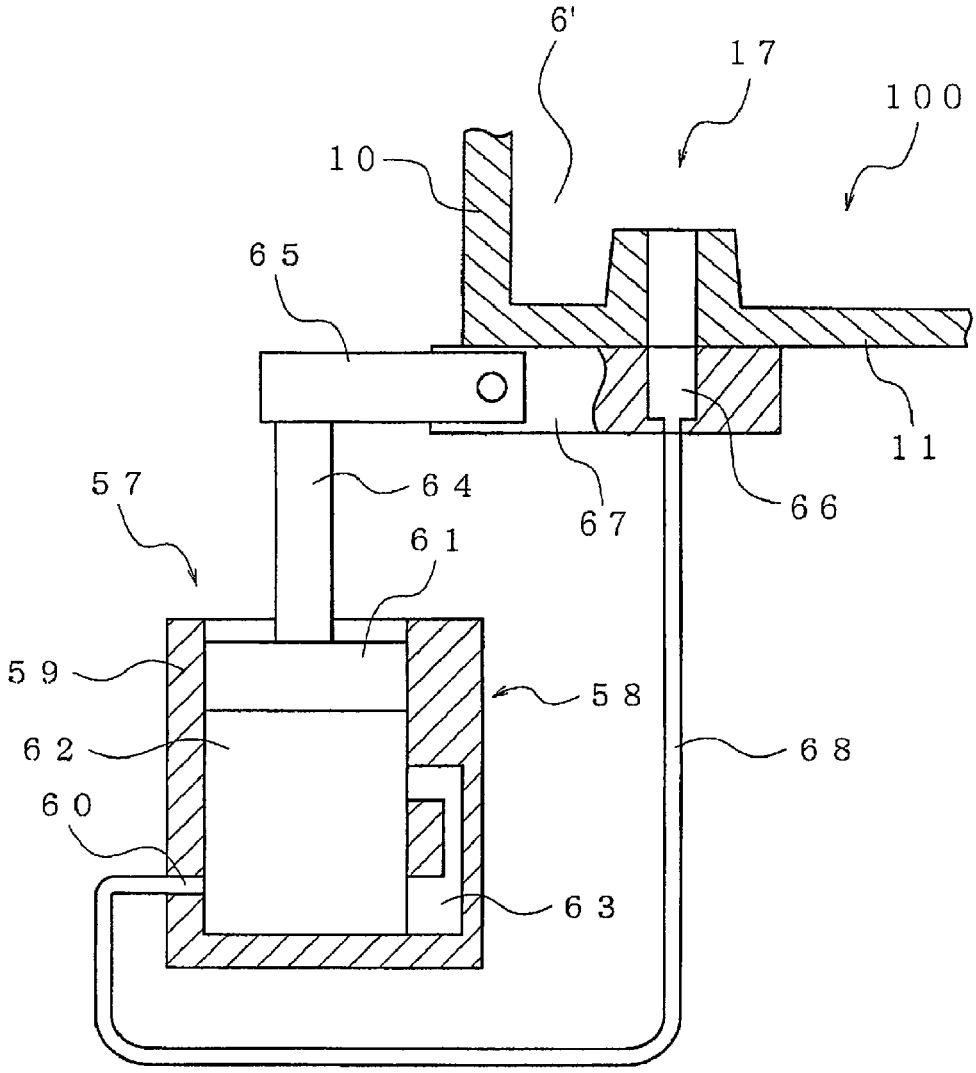
FIG. 9 is a cross-sectional view of a pump, according to still another embodiment of the present invention.

A pump mechanism 57 according to yet another embodiment of the present invention may be placed as shown in FIG. 9. In this embodiment, pump mechanism 57 shares many similarities to pump mechanism 47, with pump 57 being rotated upside down relative to the position of pump 47. An air chamber 62 may be open to the outside of a cylinder 58 at the top of cylinder 58. The bottom of cylinder 58 may be closed. A communication hole 60 may be formed through side wall 59 at a lower portion of side wall 59. A lower end of a passage 63 may be open to air chamber 62 at the inner surface of side wall 59. Passage 63 may extend upward in side wall 59 and an upper end of passage 63 may be open to air chamber 62 at the inner surface of side wall 59.

In this embodiment of the present invention, one end of a piston rod 64 may be connected to a piston 61 and the other end of piston rod 64 may be connected to arm 65. Arm 65 supports an adapter 67 through which a communication hole 66 may be formed at a position corresponding to ink introduction hole 17. Further, communication hole 60 of cylinder 58 and communication hole 66 of adapter 67 may be connected via a flexible tube 68.

When ink cartridge 100 contacts and pushes adapter 67, piston 61 may be pushed down, thus, compressing air in air chamber 62. This compressed air may be supplied into ink cartridge 100 via a flexible tube 68. As piston 61 is pushed further down, the interior of ink cartridge 100 may communicate with the atmosphere via passage 63.

Adapter 67 may be separated from arm 65 and may be configured to move up and down. The position of adapter 67 may be detected by a sensor (not shown). Depending on the position of the adapter 67 detected by the sensor, pressure may be supplied to ink cartridge 100 via flexible tube 68, and communication between the interior of ink cartridge 100 and the atmosphere via flexible tube 68 may be established.

In the above-described embodiments, a recording head may be attached to an ink cartridge holder. Nevertheless, the present invention also may be applied to a system where a recording head is provided separately from an ink cartridge holder. The present invention also may be applied to a system in which a recording head is provided separately from an ink cartridge holder at a position higher than the ink cartridge holder. Because an ink cartridge is positioned below the recording head in such systems, negative pressure may be applied to ink in the recording head without a negative pressure generating member within the ink cartridge. The present invention also may be applied to a system where the recording head and the ink cartridge holder are connected via a flexible tube.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

The invention claimed is:

1. A method for mounting an ink cartridge, the cartridge comprising a case having a first opening and second opening formed therethrough and an ink chamber formed within the case, comprising:

dispensing ink from an interior of the ink chamber to an exterior of an ink chamber via the first opening;

selectively creating a seal between the first opening and a joint portion of an ink cartridge holder after dispensing ink from the interior of the ink chamber to the exterior of the ink chamber via the first opening;

placing the ink chamber and an exterior of the case in fluid communication via the second opening; and joining an ink dispensed from the interior of the ink chamber via the first opening with an ink retained in the joint portion prior to the step of selectively creating the seal between the first opening and the joint portion.

2. The method of claim 1, further comprising preventing the ink chamber and the exterior of the case from being in fluid communication prior to the step of placing the ink chamber and the exterior of the case in fluid communication via the second opening.

3. The method of claim 1, wherein the step of dispensing ink further comprises introducing a compressed air into the ink chamber via the second opening.

4. The method of claim 1, wherein the step of placing the ink chamber and the exterior of the case in fluid communication via the second opening is performed after the step of selectively creating the seal between the first opening and the joint portion.

5. The method of claim 1, further comprising:

applying a negative pressure to an ink within a recording head via the ink retained in the joint portion, wherein the joint portion is connected to the recording head.

6. The method of claim 1, wherein the step of dispensing ink further comprises:

moving ink retained by an ink meniscus formed in the first opening towards an outer end of the first opening.

* * * * *